US006539740B1

(12) United States Patent
Santana, Jr.

(10) Patent No.: US 6,539,740 B1
(45) Date of Patent: Apr. 1, 2003

(54) FOOD SERVICE DISPLAY COOLER

(76) Inventor: Manuel Santana, Jr., 5471 Lake Le Clare Rd., Lutz, FL (US) 33549

( * ) Notice: Subject to any disclaimer, the term of this patent is extended or adjusted under 35 U.S.C. 154(b) by 0 days.

(21) Appl. No.: 10/062,242

(22) Filed: Feb. 1, 2002

(51) Int. Cl.[7] ..... A47F 3/04
(52) U.S. Cl. ..... 62/255; 62/257
(58) Field of Search ..... 62/246, 255, 257, 62/440

(56) References Cited

U.S. PATENT DOCUMENTS

| | | | | | |
|---|---|---|---|---|---|
| 2,150,195 | A | * | 3/1939 | Valade | 312/139 |
| 2,425,473 | A | * | 8/1947 | Hoffman | 62/254 |
| 4,306,616 | A | | 12/1981 | Woods, Jr. et al. | |
| 4,408,465 | A | | 10/1983 | Ibrahim | |
| 4,592,209 | A | | 6/1986 | Casanova et al. | |
| 4,603,557 | A | | 8/1986 | Halbmann | |
| 4,633,677 | A | * | 1/1987 | Maehara | 62/256 |
| 4,723,414 | A | * | 2/1988 | Hurutachi et al. | 62/155 |
| 4,856,579 | A | | 8/1989 | Wolfe | |
| 5,207,490 | A | | 5/1993 | Kaspar et al. | |
| 5,247,807 | A | * | 9/1993 | Jarman et al. | 62/227 |
| 5,388,429 | A | * | 2/1995 | Shackelford et al. | 62/446 |
| 5,477,702 | A | * | 12/1995 | Kennedy et al. | 62/256 |
| 5,590,541 | A | * | 1/1997 | Rainwater | 62/255 |
| 5,865,037 | A | * | 2/1999 | Bostic | 62/371 |
| 6,116,029 | A | * | 9/2000 | Krawec | 62/3.3 |
| 6,182,459 | B1 | | 2/2001 | Hertel | |

FOREIGN PATENT DOCUMENTS

| | | |
|---|---|---|
| DE | 2910344 A1 | 10/1980 |
| JP | 613774 | 5/1994 |

* cited by examiner

*Primary Examiner*—William E. Tapolcai
*Assistant Examiner*—Mohammad M. Ali
(74) *Attorney, Agent, or Firm*—Pettis & Van Royen, PA

(57) ABSTRACT

A food display cooler for display of packaged and non-packaged food products for self-service by customers. The cooler simultaneously provides a cooled frosted display platform and a blanket of cooled air above the display platform and over the food products. The display platform is pivotally mounted to a pan underlying the display platform. The display platform has a first cooling coil attached directly to the bottom surface of the display platform and a second cooling coil and a fan is connected to the display platform such that the cooling coil pivots with the display platform when it is pivoted to the open position. A refrigeration unit is connected in fluid flow communication with the cooling coil, and is connected to the exterior surface of the pan.

8 Claims, 5 Drawing Sheets

FOOD SERVICE DISPLAY COOLER

BACKGROUND OF THE INVENTION

1. Field of the Invention

The present invention relates to a food service display cooler for display of food products for self-service by customers. The cooler provides a cooled frosted display surface and a blanket of cooled air above the food products. The cooler is particularly structured for easy cleaning and service.

2. Description of the Prior Art

Display units for presentation of perishable foods are used throughout the food industry, including supermarkets and restaurants. These units include refrigerated shelves and display cases.

The refrigerated shelves are simple devices that include cooling coils attached to their bottom surface so that the products placed on the shelves are cooled from the bottom. This type of shelf frequently is cold enough to create a frost coating on the shelf surface. However, refrigerated shelves leave the upper portion of the food containers spaced too far apart from the cooling source permitting contact with warm ambient air, resulting in food spoilage.

Some refrigerated cabinets attempt to put a shield of cooled circulating air across the front of the cabinet to prevent the ingress of warm ambient air into the interior of the cabinet. The air current is not secure enough or complete enough to prevent the ingress of ambient air into the interior of the cabinet and to adequately cool the food products.

In refrigerated counter displays, the cooling is accomplished by maintaining a forced circulation of cold air over the display surface and the containers housing the food that are placed on the display surface. This is frequently unsatisfactory as the cooled air does not always flow over all the food products, as some food products are shielded from the air flow; therefore, cooled air may also be passed underneath the display surface.

Not withstanding the existence of such prior art refrigerated units, it remains clear that there is a need for refrigerated units capable of cooling the display platform, cooling the air above the display platform, restricting the flow of ambient air into the air above the display platform, and providing easy access to the fan, to the coils, and to the pan for cleaning and servicing purposes.

SUMMARY OF THE INVENTION

The present invention relates to a food service display cooler for presentation of packaged and unpackaged food products for self-service by customers. Most simply stated, the cooler of this invention comprises a pan having a bottom, at least one side and an exterior surface. The pan is mountable to a support, which may comprise a stainless-steel frame, wood cabinetry or any suitable support system. A display platform is pivotally mounted to the pan so that the display platform comprises a top for the pan. The display platform itself has a top surface and a bottom surface. A first cooling coil is attached to the bottom surface of the display platform and a second cooling coil and fan are connected to the bottom of the pan such that the two cooling coils and the fan pivots with the display platform when it is pivoted between a closed and an open position. A condensing unit is connected in fluid flow communication with both cooling coils, and is connected to the exterior surface of the pan.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DESCRIPTION OF A PREFERRED EMBODIMENT

Figure 1:
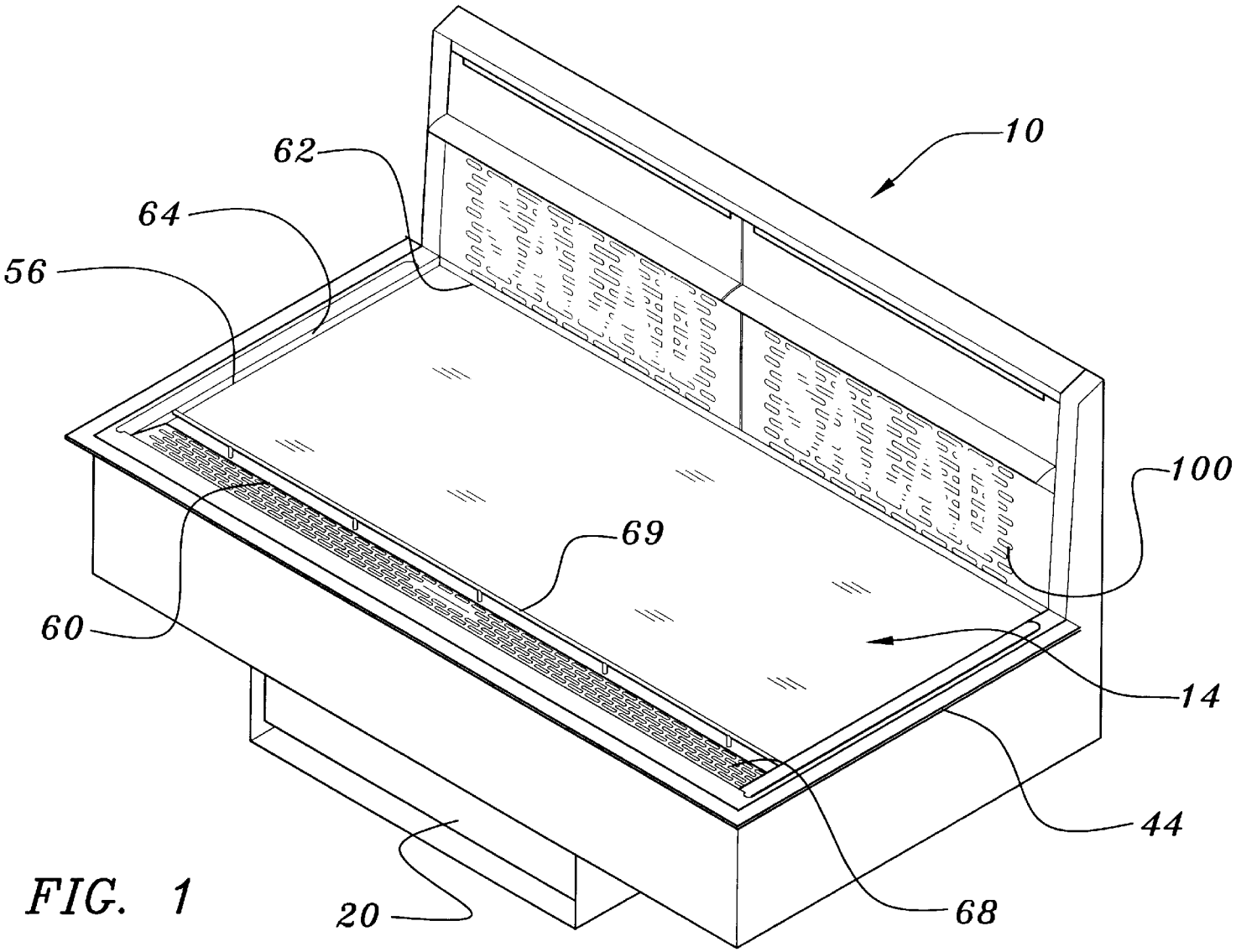
FIG. 1 is an isometric view of the food service display cooler of this invention.

A preferred embodiment for the food service display cooler of this invention is illustrated in the drawing FIGS. 1–5, in which the apparatus is generally indicated as 10. Referring first to the view of FIG. 3, it can be seen that the display cooler 10 comprises a pan generally indicated as 12, a display platform generally indicated as 14, a first cooling coil 16, a second cooling coil 18 and a condensing unit 20.

The pan 12 has a bottom 22, an exterior surface 24, and at least one side and is constructed from stainless-steel. In a preferred embodiment the pan may be any suitable shape, including cylindrical with a circular cross-section. In a preferred embodiment illustrated in the drawing figures, the pan 12 is rectangular and comprises a front side 26, a left side 28, a right side 30 and a backside 32. Additionally, the pan 12 is covered by insulation 34, which may be foam, fiberglass batting or other suitable insulating material. To protect the insulation and provide a more rigid structure, the insulation 34 is protected by a stainless-steel first cover 36 which is attached to the pan 12.

The cover 36 is constructed with sufficient thickness to support attachment of frame 38 directly to the first cover 36 by welding the flanges 37 to the first cover 36 or the frame 38 may be attached by other suitable well-known means. The frame 38 is sized and configured to support the condensing unit 20, which is mounted therein. In other embodiments, support members (not shown) may be installed between the pan 12 and the first cover 36 to provide additional support for the frame 38.

The display cooler 10 is a drop in unit that may be mounted within any suitable cabinet 40, which is shown in phantom. The cabinet 40 may also be constructed so that additional support may be provided to the frame 38 to support the weight of the condensing unit 20. A top edge 42 joins the pan 12 to the first cover 36. A rim 44 extends outwardly from top edge 42 so that the pan 12 rests upon the cabinet 40 to support the display cooler 10. The rim 44 may be sealed to the cabinet to prevent food from passing into the interior of the cabinet and creating a biological hazard.

Figure 4:
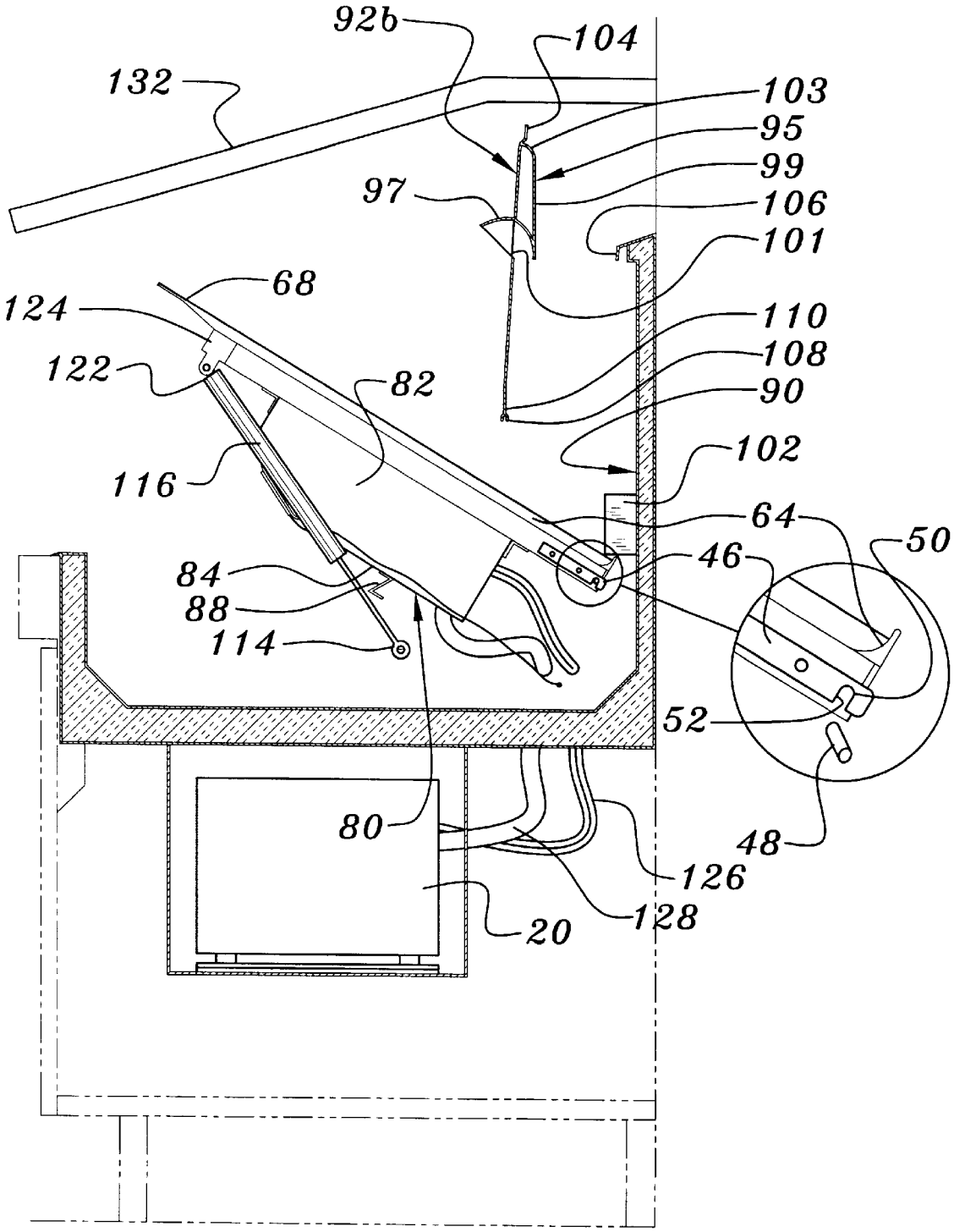
FIG. 4 is the right side elevational view of FIG. 3, illustrating pivoting the display platform between a closed position and an open position and removal of the subpanels.

The display platform 14 is pivotally connected to the pan 12 by a pair of hooks 46 that are attached to opposing sides of the display platform 14, as seen in FIG. 4. Each hook 46 engages a corresponding pin 48 that is mounted to the adjacent portion of the interior of the pan 12, by welding, bolting, or other well-known means. Each hook 46 comprises a hole 50 therethrough and an opening slot 52 that is sized to receive the pin 48 therethrough. Therefore, the display platform 14 and its attached coil and fan may be detached from the pan 12 for repair or other services.

Figure 3:
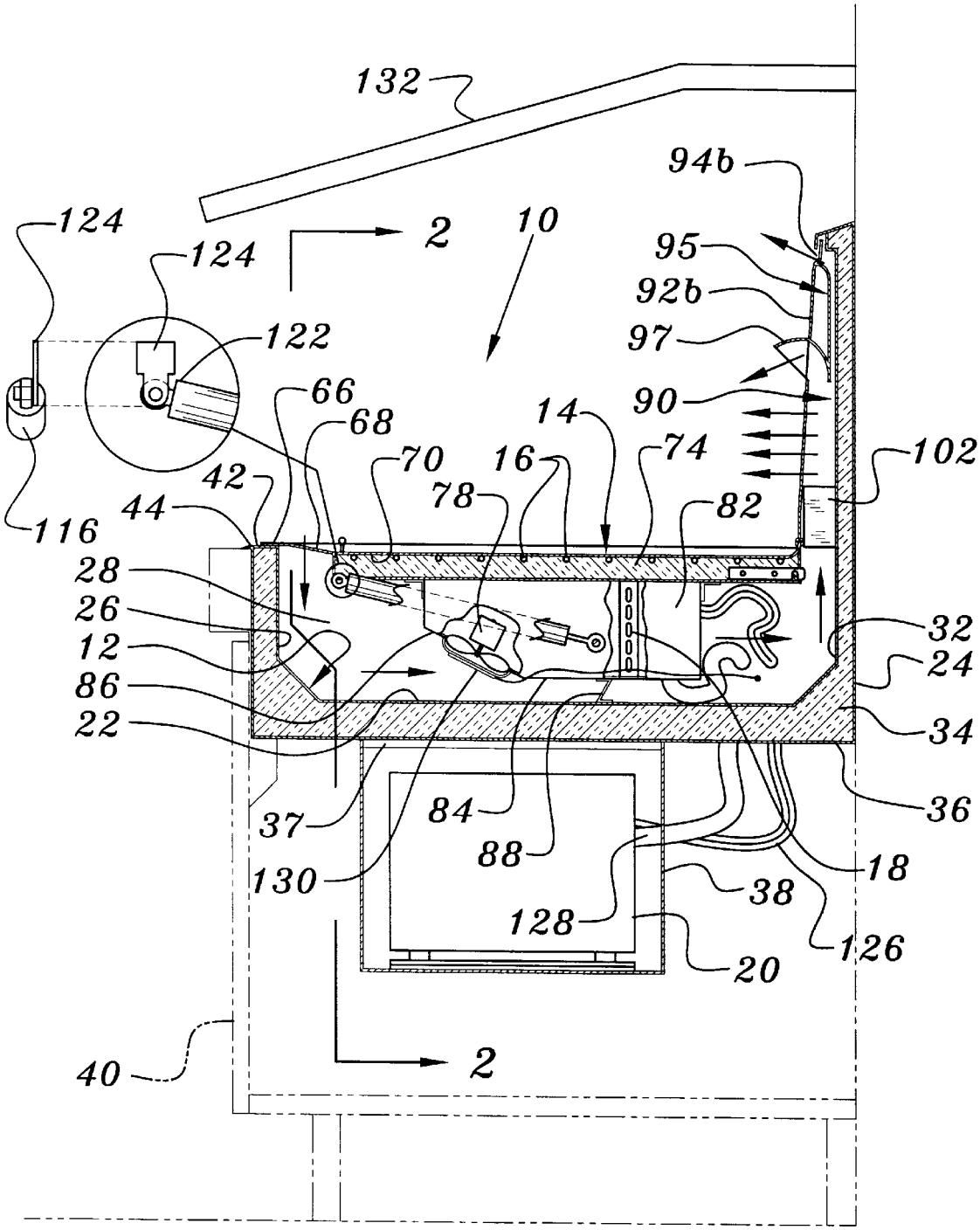
FIG. 3 is a cross-sectional right side elevational view of the invention taken along line 3—3 of FIG. 2.

The display platform 14, as seen in FIG. 1 and FIG. 3, comprises a generally flat surface. In a preferred embodiment, the display platform 14 has a left edge 56 a right edge 58, a front edge 60 and a rear edge 62, that combined form the peripheral edge of the display platform 14. Along that peripheral edge is formed a wall 64 that extends generally vertically upwardly along the right, left, front, and rear edges. The front portion of the wall 64 is angled upwardly, generally 15 degrees from the horizontal, to create a sloped front portion of the wall 64. The wall 64 forms a well that keeps the food containers and any spillage on the display platform. A flange 66 extends outwardly from the front and side portions of the wall 64 so that the flange 66 engages the top edge 42 of the pan 12 and first cover 36 for support thereon. The front portion of the wall 64 is perforated forming a return vent 68. As seen in FIG. 1, a rail 69 is attached along the front edge 60 of the display platform to prevent food products from covering the return vent 68 and to serve as a handle when pivoting the display platform 14.

Figure 5:
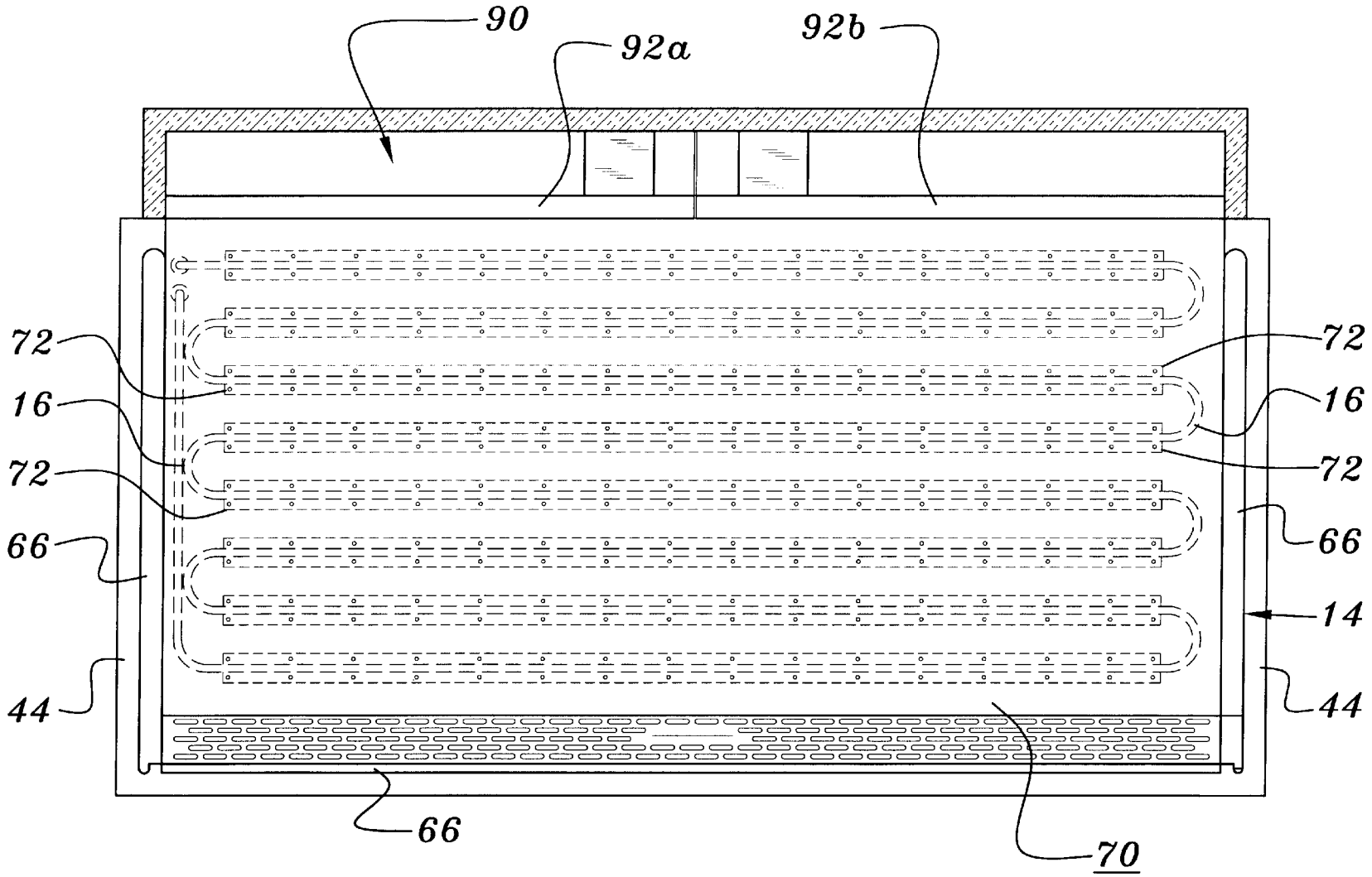
FIG. 5 is a cross-sectional top plan view of the display platform of the invention taken along the line 5—5 of FIG. 2.

The first cooling coil 16 is formed from copper tubing, and at least a portion of its longitudinal length adjoins the bottom surface 70 of the display platform 14, as seen in FIG. 3, and more clearly in FIG. 5. The first cooling coil 16 is applied in a serpentine pattern, which may take any form as long as it evenly distributes the first cooling coil across the portion of the bottom surface that is desired to be cooled, or across all of the bottom surface 70. The first cooling coil 16 is held against the bottom surface 70 by a number of copper plates 72, that are tack welded or are attached by other well-known means to the bottom surface 70. The first cooling coil 16 and the plates 72 are preferably formed from copper to take advantage of its high conductivity. The plates 72 increase the effectiveness of the heat transfer from the display platform 14 to the cooling coil, thereby evenly cooling the display platform 14. To further improve the transfer of heat from the display platform, insulation 74 is applied to the bottom surface of the display platform covering the first cooling coil 16. A second cover 76 is attached to the bottom surface 70 of the display platform 14 to protect the insulation material 74.

This second cover 76 is constructed from sufficiently strong stainless-steel so that it is capable of supporting at least one fan 78 and the second cooling coil 18 that are attached thereto, and thus connected to the display platform, so that they are pivoted with the display platform. The fan 78 creates an airflow in accordance with the arrows shown in FIG. 3. The airflow passes through the second cooling coil 18 thereby reducing the temperature of the air. Those skilled in the art will be able to determine the fan size needed to create the amount of airflow required to maintain the preferred air temperature above the display platform 14 that is needed to maintain the food at the temperature necessary to control the growth of bacteria in the food, without over cooling or freezing the food. Airflow is determined by fan size and speed. In a preferred embodiment, in order to distribute the airflow along the longitudinal length of the display platform and to fit the fans within the space available, four variable speed fans 78 are provided. The second cooling coil 18 is a standard cooling coil used for transferring heat in refrigeration systems, which preferably would include fins attached to the coils for more efficient heat transfer. The size of the cooling coil 18 will be determined by those skilled in the art based upon the heat load and the temperatures required.

In a preferred embodiment, a longitudinally extending U-shaped support 80 is used to attach the fan 78 to the second cover 76, to support the second cooling coil 18 and to a guide the airflow through the cooling coil 18. The U-shaped support 80 has two opposing sides 82 and a bottom 84. A portion 86 of the bottom 84 is angled to more readily receive the return airflow through the fans. The sides 82 of U-shaped support 80 extends along the direction of airflow; and the end opposing the fans is open to permit airflow therethrough. A Z-shaped member 88 is mounted to the U-shaped support 80 so that it lies between the pan 12 and the bottom 84 of the U-shaped support 80 to prevent the airflow from bypassing the fans and bypassing the second cooling coil 18. In other preferred embodiments, supports (not shown) may be attached to the display platform 14 and to the second cover 76 to prevent the weight of the U-shaped support 80 and the equipment mounted therein, from pulling the second cover 76 away from the display platform 14.

Figure 2:
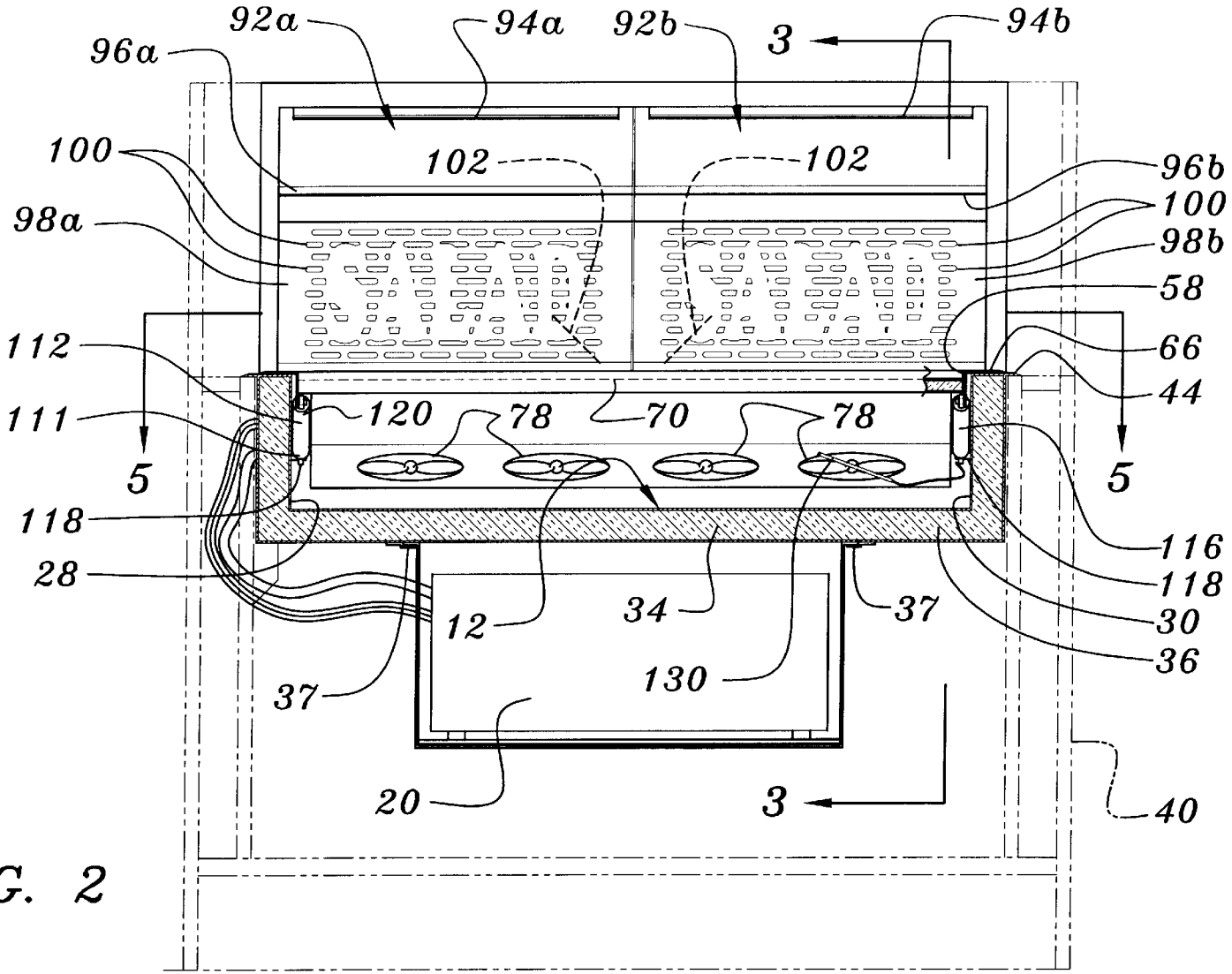
FIG. 2 is a cross-sectional front elevational view of the invention taken along line 2—2 of FIG. 3.

An air duct 90 extends upwardly from a portion of one side of the pan, in a preferred embodiment, from the back side 32. As seen in FIG. 3, the insulation material 34 extends upwardly adjacent to the air duct 90 to reduce the cooling loss. The front panel of the display cooler 10 forms the front of the air duct 90. In a preferred embodiment, for ease of handling, the front panel is subdivided into two subpanels 92*a* and 92*b*. The air duct 90 has at least one vent formed in the subpanels that is aligned such that the airflow passes over the display platform 14. As seen in FIG. 1 and FIG. 2, in a preferred embodiment, there are a plurality of vents passing through the subpanels 92*a* and 92*b*. Each subpanel 92*a* and 92*b* has first vents, 94*a* and 94*b* respectively, that direct a portion of the airflow upwardly and away from the display platform 14, has second vents 96*a* and 96*b*, respectively, that direct a portion of the airflow downwardly toward the display platform 14, and has third vents 98*a* and 98*b*, respectively, that comprises a plurality of apertures 100, which permit a portion of the airflow to move laterally outwardly from the air duct 90. The vents 96*a* and 96*b* lie intermediate vents 92*a* and 92*b* and 98*a* and 98*b*. This provides the most even flow of cooled air about the food products and food containers. The vents 98*a* and 98*b* provide cooling for the food products and food containers on the rear portion of the display platform 14. The vents 96*a* and 96*b* are sufficiently raised and angled to provide cooled air to those food products placed on the middle of the display platform 14 and forward to the front of the display platform. The vents 92*a* and 92*b* are sufficiently high and the air is directed upwardly to provide cooled air to the food products and food containers on the front portion of the display platform 14. This airflow also provides a curtain of air that helps prevent the ingress of ambient air onto the food products. As seen in FIG. 3, the airflow entering the duct 90 is directed first by a pair diverters 102 to assist movement of the airflow toward the sides of the air duct to provide an even flow of air across the vents. As can be seen in FIG. 4, the subpanels 92*a* (not shown) and 92*b* are removable. A channel 106 is attached to the top of the air duct 90, and a U-shaped projection 108 is attached to the bottom edge 110 of each subpanel 92*a* and 92*b*. To install the panels, the top edge 104 of each subpanel is received in its corresponding portion of the channel 106 and each panel is lowered so that the U-shaped projection 108 captures a portion of the rear wall 56 that extends along the back edge 62 of the display platform 14, thereby holding the panels in place.

In a preferred embodiment, the amount and direction of airflow passing through each of the three vents is controlled by an insert 95 attached to the back of the subpanels. The insert 95 comprises a hood 97 and a plate 99. The hood is attached adjacent to the opening 101 of the second vents 96*a* and 96*b* and is angled downwardly to direct the airflow toward the top of the display platform 14. The plate 99 is inserted between the subpanels and the back wall of the duct 90. The spacing between the plate 99 and the back wall of the duct 90 determines the amount of airflow that is permitted to exit from the first vents 94*a* and 94*b*. Also, the upper portion 103 of the plate 99 is curved or angled in order to direct the airflow from the first vents 94*a* and 94*b*. In a preferred embodiment the upper portion 103 directs the airflow upwardly as it exits the first vents 94*a* and 94*b*, as seen in FIG. 3. The number of apertures 100 through the subpanels will control the amount of airflow that is permitted to exit generally laterally through the third vents 98*a* and 98*b*. In a preferred embodiment, a sneeze guard 132 is mounted to adjacent wall structure as seen in FIG. 4, or it may be directly mounted to the display cooler 10. The use of the sneeze guard 132 will affect the airflow over the display platform 14, and may be used to direct the air downwardly toward the return vent 68 to keep the warmer ambient air from entering the space around the food and the food containers.

In a preferred embodiment, as seen in FIG. 2, one end 111 of a first 65 lb. gas shock 112 is pivotally attached to the left side 28 of the pan 12 and as seen in FIG. 2 and FIG. 4, one end 114 of a second 65 lb. gas shock 116 is pivotally attached the right side 30 of the pan 12 by brackets 118. These brackets are attached to the pan 12 by welding or bolting. The other end 120 of the first gas shock 112 is pivotally attached to the left side of the display platform 14 and the other end 122 of the gas shock 116 is pivotally attached to the right side of the display platform 14. The gas shocks 112 and 116 are attached to the display platform 14 by brackets 124, which can be seen most clearly in FIG. 3. The brackets 124 may be attached to the display platform 14 by welding or other suitable means. Sixty-five lb. gas shocks are suitable for the particular sized display cooler 10 illustrated in the drawings; however, those skilled in the art will be able to determine the appropriate size and power of the gas shocks needed for other embodiments of the display cooler 10, based upon the weight of the display platform 14 and all the equipment that is attached thereto. The shocks 112 and 116 are installed to enable a person to easily lift the front of the display platform 14 and pivot it about the pins 48. Those skilled in the art will be able to determine the proper positioning for the attachment of the ends 111 and 114 to the pan 12, so that the force provided by the pistons may be properly applied to the display platform so that the display platform may be easily pivoted between its closed position and its fully open position.

The first cooling coil 16 and the second cooling coil 18 are each connected in fluid flow relationship with the condensing unit 20 by the insulated tubes 126 and power is provided to the fans through cable 128. In a preferred embodiment, the cooling coils may be attached in fluid flow relationship in series to one another and to the condensing unit 20. In another preferred embodiment, the cooling coils may be attached in parallel to the condensing unit 20 so that the temperature maintained in each cooling coil may be controlled independently. Those skilled in the art will readily be able to determine the size of the condensing unit 20 needed to support the maximum heat load on the display platform. The controls (not shown) necessary for operating the condensing unit 20 are mounted adjacent thereto. At least one temperature sensor 130 is connected to the control unit (not shown) and is mounted adjacent to the fan unit to measure the temperature of the return air so that the operation of the condensing unit may be automatically adjusted by the controls to maintained the proper temperatures.

Stainless steel is the primary material from which the display cooler 10 is constructed in order to meet cleanliness standards. In addition, welding is the preferred means for connecting parts together in order to provide a tight and smooth seal, again to enable easy cleanup of these parts. Certainly the condensing unit 20, which is not in the food area, will be constructed from materials that are suitable for a standard condensing unit. As mentioned previously, the cooling coils 16 and 18, as well as the plates 72 are constructed from copper due to its efficient heat conductivity. Cabinetry, which is not part of the display cooler 10, may be constructed from wood, particularly decorative areas, stainless steel or other suitable materials.

Having thus set forth a preferred construction for the current invention, is to the remembered that this is but the preferred embodiment. Attention is now invited to a description of the use of the display cooler 10.

The display cooler 10 is used to display packaged and unpackaged food products for self-service by the customer. The display cooler 10 is constructed to meet the National Sanitation Foundation standard #7, which provides the requirements for refrigerated food display.

The display cooler 10 may be mounted on a simple stainless steel cabinet. comprising a frame with legs, or on a more decorative cabinet made from stainless steel or wood. When the condensing unit 20 is in operation, air is circulated by the fan 78 through the cooling coil 18 through the duct 90 and out at least one vent. The amount of airflow is controlled by the number of fans, the fan speed and the fan sizes. The direction and quantity of flow of cooled airflow through the ducts is controlled insert 95. Obviously, the number of fans and the size of fans is predetermined during the construction of a particular embodiment of the display cooler 10. However, adjustments in the fan speed, and the spacing of the insert can be used to adjust the quantity and direction of airflow. Control of the quantity and direction of the airflow is essential to apply adequate cooling temperatures evenly to the food containers and the food therein. Also, providing a curtain of cooled air helps prevent the incursion of ambient air into the area above the food containers. The food containers will have a tendency to block horizontal airflow, therefore in order to cool the containers further away from the third vents 98*a* and 98*b*, airflow is projected outwardly and downwardly toward the front half of the display platform 14 to ensure that cooled airflow surrounds the containers toward the front of the display platform 14. Airflow that is angled upwardly from the first vents 94*a* and 94*b* is projected further outwardly so that it can provide a curtain of air that will block the incursion of the warmer ambient air. The return of as much of the airflow as possible through the return vent 68 will help maintain the air curtain and the efficiency of the display cooler 10. The use of the sneeze guard 132 will also redirect the airflow from the first vents 94*a* and 94*b* toward the return vent 68 further helping to block the incursion of warmer ambient air.

The first cooling coil, which is attached to the bottom of the display platform 14, is operated at a temperature that is sufficiently cool to create a layer of frost on the top surface of the display platform upon which the food containers rest, which presents an attractive display. However, more importantly the direct cooling of the display platform 14 is essential to provide cooling of the food containers from the bottom so that in combination with the cooling that is provided by the cooled airflow across top of the display platform 14, proper temperatures within the food can be maintained to prevent bacterial growth and thereby meet the food industry standards for safe handling of food products.

After the display cooler has been closed to customers, the food has been removed and the condensing unit 20 has been turned off so that the display platform has become sufficiently warm, the top surface of the display platform 14 is easily cleaned removing any food spillage. Now the sub-panels 92*a* and 92*b* are removed so that the display platform 14 may be lifted and pivoted upwardly to gain easy access to the pan 12. As the fans and second cooling coil 18 are connected to the display platform, they are pivoted out from within the pan 12 area leaving the pan 12 bare. Now the pan 12 may be easily and thoroughly cleaned, removing all food spillage to prevent the formation of bacteria. With the display platform 14 in the open position, as shown in FIG. 4, it will be easy to clean the fans 78 and the second cooling coil 18 to ensure that they are also clean. Most of the food spillage will occur through the return vent and between the flange 66 of the display platform 14 and the rim 44 of the pan 12. The fan and cooling coil 18 is sufficiently spaced apart from the return vent 68 and is housed within the U-shaped support 80, so most food spillage will be directly into the pan 12 for easy cleanup and little if any will contaminate the fan or cooling coil 18.

While the foregoing describes particularly preferred embodiments of the present invention, it is to be understood that numerous variations and modifications of the structure will occur to those skilled in the art. Accordingly, the foregoing description is to be considered illustrative only of the principles of this invention and is not to be considered limitative thereof, the scope of the invention being determined solely by the claims appended hereto.

What is claimed is:

1. A food service display cooler comprising:

a pan having a bottom, a bottom surface and at least one side, said pan being mountable to a support;

a display platform being pivotally connected to said pan such that said display platform comprises a top for said pan, said display platform having a bottom surface and a top surface;

a first cooling coil having a portion of the longitudinal length thereof adjoining said bottom surface of said display platform and pivoting therewith;

a fan connected to said bottom of said display platform such that said pan pivots therewith, said fan creating an air flow;

an air duct extending upwardly from at least a portion of one side of said pan, said air duct having at least one vent therethrough aligned such that said air flow passes over said display platform;

a second cooling coil connected to said display platform such that said air flow passes through said second cooling coil, through said duct, out said vent, and over said top surface of said display platform; and a condensing unit connected in fluid flow relationship to said first and second cooling coils.

2. A food service display cooler as in claim 1, wherein said first and second cooling coils are connected in series, such that said first and second coils are in fluid flow communication with each other and with said refrigeration unit.

3. A food service display cooler as in claim 1, wherein said first and second cooling coils are connected in parallel, such that each of said first and second coils are in fluid flow communication with said refrigeration unit.

4. A food service display cooler comprising:

a pan having a bottom, a bottom surface and at least one side, said pan being mountable to a support;

a display platform being pivotally connected to said pan such that said display platform comprises a top for said pan, said display platform having a bottom surface and a top surface;

a first cooling coil having a portion of the longitudinal length thereof adjoining said bottom surface of said display platform and pivoting therewith;

a fan connected to said bottom of said display platform such that said pan pivots therewith, said fan creating an air flow;

an air duct extending upwardly from at least a portion of one side of said pan, said air duct having a plurality of vents in said air duct, a first vent directing a portion of said airflow upwardly, a second vent in which a portion of said airflow is directed downwardly and a third vent comprising a plurality of apertures therethrough such that a portion of said airflow is directed laterally outwardly from said air duct a second cooling coil connected to said display platform such that said air flow passes through said second cooling coil, through said duct, out said vent, and over said top surface of said display platform; and a condensing unit connected in fluid flow relationship to said first and second cooling coils.

5. A food service display cooler as in claim 4, wherein said second vent lies intermediate said first and third vents.

6. A food service display cooler as in claim 4, wherein said first and second cooling coils are connected in series, such that said first and second coils are in fluid flow communication with each other and with said refrigeration unit.

7. A food service display cooler as in claim 4, wherein said first and second cooling coils are connected in parallel, such that each of said first and second coils are in fluid flow communication with said refrigeration unit.

8. A food service display cooler comprising:

a pan having a bottom, a bottom surface and at least one side, said pan being mountable to a support;

a display platform being pivotally connected to said pan such that said display platform comprises a top for said pan, said display platform having a bottom surface and a top surface;

a first cooling coil having a portion of the longitudinal length thereof adjoining said bottom surface of said display platform and pivoting therewith;

a fan connected to said bottom of said display platform such that said pan pivots therewith, said fan creating an air flow;

an air duct extending upwardly from at least a portion of one side of said pan, said air duct having a second vent in said duct in which a portion of said airflow is directed downwardly and a third vent in said duct comprising a plurality of apertures therethrough such that a portion of said airflow is directed laterally outwardly from said air duct a second cooling coil connected to said display platform such that said air flow passes through said second cooling coil, through said duct, out said vent, and over said top surface of said display platform; and a condensing unit connected in fluid flow relationship to said first and second cooling coils.

* * * * *